US006105628A

United States Patent [19]

Duhamel

[11] Patent Number: 6,105,628

[45] Date of Patent: Aug. 22, 2000

[54] ELECTROMAGNETIC DEVICE FOR AUTOMATED JACQUARD MACHINE NEEDLE ACTUATION

[75] Inventor: Franck Duhamel, Bemes les Ardress, France

[73] Assignee: Dentelles Darquer, Calais, France

[21] Appl. No.: 09/155,068

[22] PCT Filed: Mar. 12, 1997

[86] PCT No.: PCT/FR97/00437

§ 371 Date: Jul. 19, 1999

§ 102(e) Date: Jul. 19, 1999

[87] PCT Pub. No.: WO97/36033

PCT Pub. Date: Oct. 2, 1997

[30] Foreign Application Priority Data

Mar. 22, 1996 [FR] France ..... 96 03834

[51] Int. Cl.[7] ..... D04C 5/18; D04B 27/32; D03C 3/20

[52] U.S. Cl. ..... 139/455; 139/319

[58] Field of Search ..... 139/455, 319, 139/59; 66/205, 207

[56] References Cited

U.S. PATENT DOCUMENTS

| | | | |
|---|---|---|---|
| 3,904,855 | 9/1975 | Geirhos et al. | 139/85 |
| 5,327,750 | 7/1994 | Speich | 139/55.1 |
| 5,676,179 | 10/1997 | Morandi | 139/455 |

FOREIGN PATENT DOCUMENTS

| | | |
|---|---|---|
| 0 304 985 | 1/1989 | European Pat. Off. . |
| 0 382 998 | 8/1990 | European Pat. Off. . |
| 2 704 562 | 4/1994 | France . |
| WO 95 06767 | 3/1995 | WIPO . |

*Primary Examiner*—Andy Falik
*Attorney, Agent, or Firm*—Wolf, Greenfield & Sacks, P.C.

[57] ABSTRACT

An electromagnetic device for controlling the needles of a Jacquard machine is provided. The electromagnetic device selectively actuates the needles of a Jacquard machine using solenoids. The solenoids control selector members and place them either in a deployed position or a withdrawn position. When the device is moved with respect to the needles of a Jacquard machine, those selector members that are in the deployed position engage pushers to move the associated needles.

13 Claims, 3 Drawing Sheets

ELECTROMAGNETIC DEVICE FOR AUTOMATED JACQUARD MACHINE NEEDLE ACTUATION

BACKGROUND OF THE INVENTION

1. Field of the Invention

The subject of the present invention is an electromagnetic device for the automated actuation of the needles of a Jacquard machine, and a Jacquard machine equipped with such a device. The invention relates more specifically to a device intended to be moved with respect to the needles of a Jacquard machine in order to push them selectively, in a selection that is established automatically on each cycle of the Jacquard machine, under the control of electromagnetic means. The invention finds a particular, but not exclusive, application in replacing the punched cards used in Jacquard machines for controlling lace-making machines, especially Leavers lace machines.

2. Description of the Related Art

It has already been proposed, particularly in European Patent Application EP-A-0 382 998, that the conventional punched cards of a Jacquard machine be replaced by an electromagnetic control device which selectively pushes the needles of the Jacquard machine. This document teaches the automatic control of the selection of each needle of the Jacquard machine using a solenoid, and more particularly a two-position solenoid comprising two concentric windings known respectively as the attraction and release windings. Electric operation of the release winding allows a selector member, in the form of a rod, to be deployed, while electric operation of the attraction winding allows this selector rod to be retracted. The device is also equipped with means allowing it to be moved with respect to the needles of the Jacquard machine. In a first embodiment, illustrated in particular in FIG. 1 of this document, the selector rod of each solenoid is associated with a passage, and its function is to close this passage when brought into the deployed position. When the device comes into contact with the needles of the Jacquard machine, all the needles which lie facing a respective passage which has been closed by a selector rod are pushed by the device when it moves. By contrast, in the case of the passages which are not closed by a selector rod, the needles of the Jacquard machine lying opposite these free passages enter the said passages when the device moves, and are therefore not pushed by this device. In a second embodiment illustrated in FIG. 4 of this document, the selector rods act respectively on intermediate pushers, and have the function of locking them in the deployed position. When a pusher is locked in the deployed position, it allows the corresponding needle of the Jacquard machine to be pushed when the device is moved. When a pusher is not locked in the deployed position, it is pushed back elastically by a return spring to a retracted position, and cannot come into contact with the associated needle.

The electromagnetic devices described in European Patent Application EP-A-0 382 998 advantageously, on the one hand, allow those needles of a Jacquard machine, which are to be pushed during a given cycle, to be selected automatically by an appropriate control of the electrical power supply to the windings of each solenoid associated with a needle and, on the other hand, allow the energy requirement for operating each solenoid to be very low. The solenoids described in this document do, however, have the drawback of being bulky and are therefore ill-suited to selecting needles in a Jacquard machine, which needles are arranged in consecutive rows with a small inter-row spacing, particularly a spacing of less than 1 centimeter.

BRIEF SUMMARY OF THE INVENTION

The object of the present invention is to propose an electromagnetic device which has the advantages of the devices of the aforementioned European Patent Application, but which is made up of electromagnetic selector members which require a smaller amount of space, so that it can be adapted to the control of the needles in a Jacquard machine, these needles being arranged in closely-spaced consecutive rows. The device of the invention more specifically finds its application in Jacquard machines used for controlling Leavers lace machines, and in which the spacing between two consecutive rows of needles is very small, and of the order of 6 mm. The invention is not, however, restricted to this particular type of Jacquard machine, but may be applied in general to any type of Jacquard machine controlled by needles which have to be pushed selectively and are arranged in consecutive rows. These may, in particular, be Jacquard machines with cords or hooks for controlling textile looms, and especially weaving looms. These may also be Jacquard machines of the type described in French Patent Application FR-A-2 704 562, in which the needles that are to be pushed, and known as falling needles, control the movement of flexible needles known as percussion needles arranged to be transverse to the falling needles. Finally, the needles of the Jacquard machine which are to be pushed selectively by the device of the invention may be arranged vertically or horizontally.

In a way which is known from the devices described in European Patent Application EP-A-0 382 998, the device of the invention, on the one hand, is intended to be moved in each cycle of the Jacquard machine with respect to the needles so as to push them individually and selectively and, on the other hand, employs, for each needle, a selector member which can move in a direction that is transverse to the direction of pushing of the device between a first, selection, position and a second, withdrawn, position, and whose movement between the two, selection and withdrawn, positions can be controlled electromagnetically in such a way that as it moves, the device pushes only those needles of the Jacquard machine which are associated with a selector member that is in the selection position.

In a way which is characteristic of the invention, the needles of the Jacquard machine being arranged in parallel rows, the device comprises a number of parallel plates spaced apart in pairs at a spacing which is the same as the spacing separating two consecutive rows of needles; in the space between two consecutive plates there are mounted, on the one hand, the selector members associated with the needles of the same row, which selector members can move in the same plane parallel to that of the plates and, on the other hand, there is, for each selector member, a two-part electromagnetic circuit allowing the creation of at least one induced electromagnetic field which is oriented so that it is transverse to the plane of the plates, the two parts of the electromagnetic circuit being mounted, one on each of the opposing faces of these two plates and consisting, respectively, of a wound main part with at least two opposite electromagnetic polar ends, and an armature for closing the electromagnetic field, this armature being positioned opposite the wound main part; each selector member also comprises a magnetized part which is positioned between the two parts of the associated electromagnetic circuit, so as to allow its movement to be controlled.

Within the context of the invention, it is conceivable for each plate to be equipped on each of its two faces either exclusively with wound parts or exclusively with armatures for closing the electromagnetic field. In this case, a plate with wound parts is alternated with a plate with closure armatures. In another alternative form of the plates of the device of the invention, all the plates will be of the same type, and each plate comprises, on one of its faces, the wound parts of the electromagnetic circuits and, on its other face, the closure armatures which are intended respectively to close each induced electromagnetic field of the wound parts of the adjacent plate. This alternative form has the advantage of reducing the manufacturing costs, because all the plates are identical. In the context of this alternative form, the wound parts and the closure armatures of a plate may be separate, and for example bonded one onto each face of each plate. However, as a preference, in order to simplify the manufacture of the plates, and thereby further reduce their cost of manufacture, each closure armature of a plate preferably consists of the base of a ferromagnetic field frame, of which the part opposite the base is wound, and which is fixed through the plate in such a way that the base and the wound part of the field frame lie one on each side of the plate.

As a preference, the device comprises, between each plate and for each selector member, a separate pusher which can move with respect to the plates in the plane of the plates and in a direction that is transverse to the axis of movement of the selector members, and which can be locked in the deployed position with respect to the plates by the associated selector member, in which position the pusher can push the associated needle of the Jacquard machine when the device moves.

It is necessary for each pusher to be able to be placed in the deployed position with respect to the plates and to the selector members by any appropriate means so that, if need be, it can be locked in this position. This can be achieved in a first alternative form by moving the assembly formed by the parallel plates and the selector members with respect to the pushers. In this first alternative form, the device comprises a reset plate, and the assembly formed by the parallel plates and the selector members can move in terms of translation with respect to the reset plate along the axis of the pushers, between a first position, in which all of the pushers are in contact with the reset plate, and in the deployed position, and a second position, in which only those pushers which are locked in the deployed position with respect to the plates are brought into contact with the corresponding needles of the Jacquard machine, the pushers which are not locked in the deployed position not being driven and remaining in contact with the reset plate.

The motion applied to the assembly formed by the parallel plates and the selector members is limited in terms of frequency and/or amplitude because of the relatively high inertia of this assembly. In an attempt to alleviate this drawback, the device of the invention comprises, in a second alternative form, a reset plate which can move in terms of translation with respect to the plates and to the selector members and along the axis of the pushers, and the function of which, in each cycle of the Jacquard machine, is to bring the pushers into the deployed position and hold them there with respect to the plates while the selector members are made to move.

The reset plate according to the invention may, in general, be used in any device which allows the needles of a Jacquard machine to be pushed automatically and selectively via pushers that can be locked in the deployed position by means of selector members. This additional feature of the invention is therefore independent of the use of the main means of the invention, that is to say the particular structure in the form of a number of parallel plates, with, for each inter-plate space, a number of two-part electromagnetic circuits each allowing the creation of at least one induced electromagnetic field oriented so that it is transverse to the plane of the plates, for controlling the movement of each member for selecting the needles of one same row. In particular, according to the invention, this reset plate could be fitted to the alternative version of FIG. 4 of European Patent Application EP-A-0 382 998.

Other features and advantages of the invention will emerge more clearly from reading the description which will now be given of a preferred embodiment of the invention, which description is given by way of nonlimiting example, and with reference to the appended drawing, in which:

DETAILED DESCRIPTION OF THE INVENTION

Figure 1:
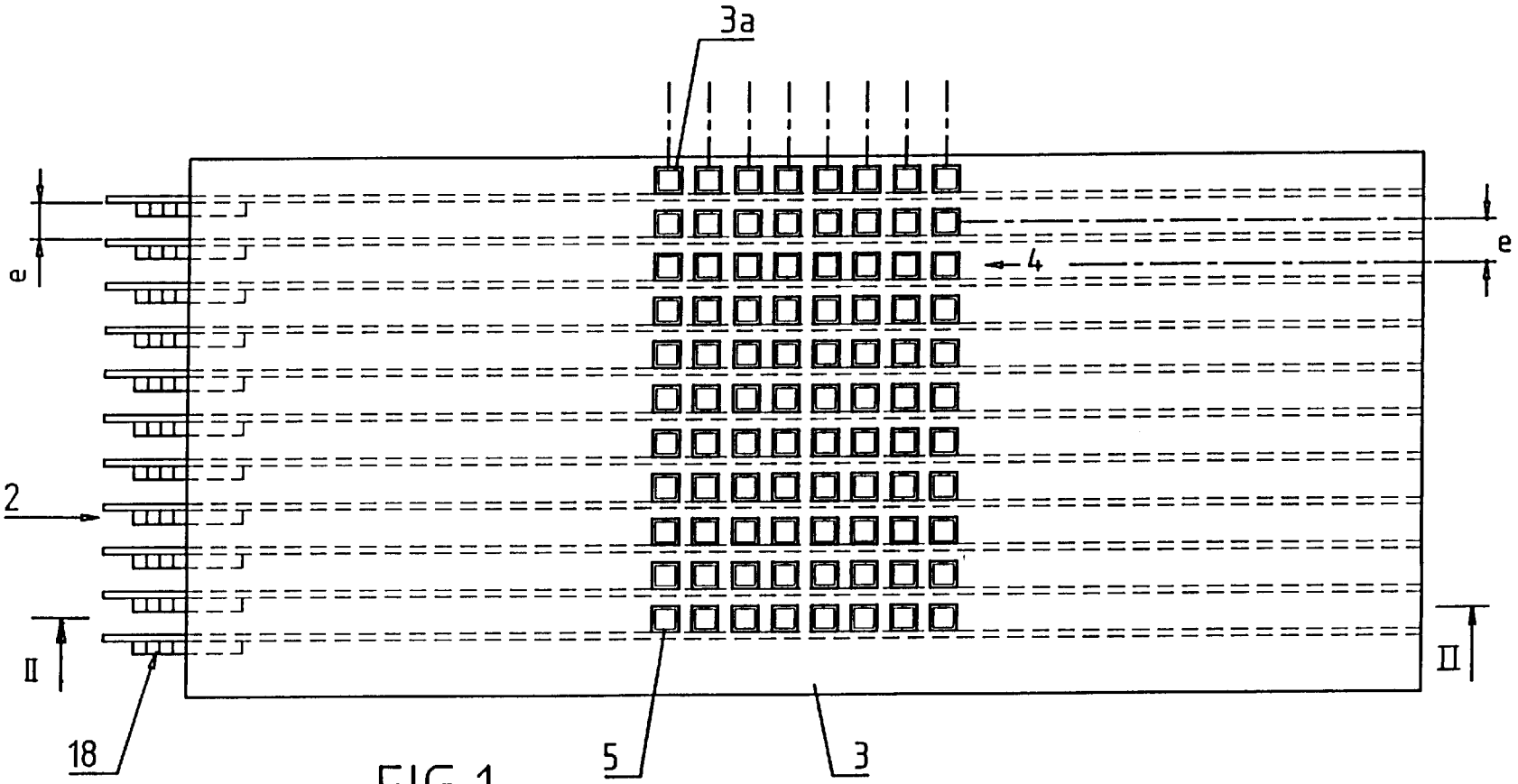
FIG. 1 is a part view from above of a device of the invention allowing automatic selection of the falling needles of a Jacquard machine, these needles being arranged in parallel rows, there being eight needles per row.
Figure 2:
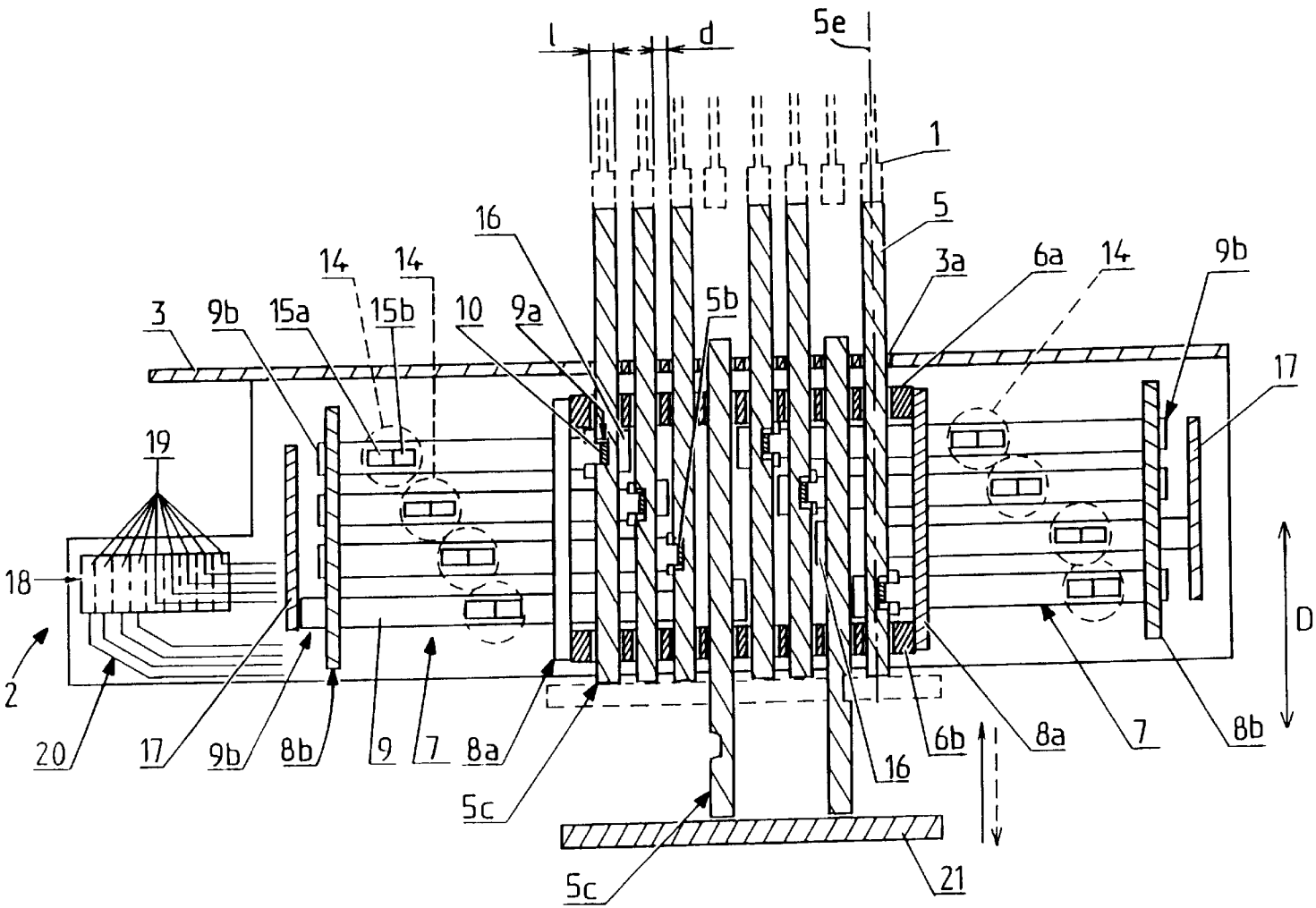
FIG. 2 is a view in section on a vertical plane of the device of FIG. 1 between two consecutive plates.
Figure 3:
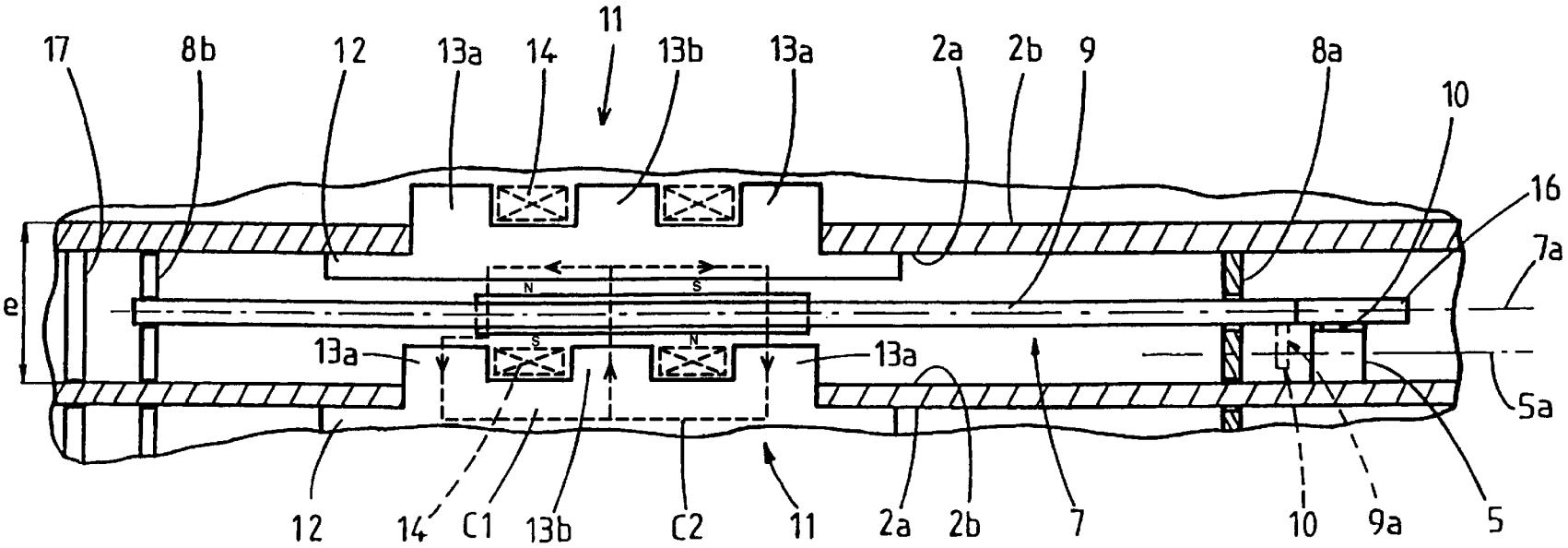
FIG. 3 is a view in section on a horizontal plane of the device of FIG. 1, homing in on a selector member between two consecutive plates.

The device of FIGS. 1 to 3 is intended to be mounted on a Jacquard machine (not depicted) with falling needles 1, more commonly called droppers, like those used for operating a Leavers lace machine. It replaces the rotary cylinder which acts as a support and drives the mistle thrush [sic] of punched cards traditionally used for selectively pushing the needles of the Jacquard machine. In the particular embodiment which will now be described, the needles 1 of the Jacquard machine are arranged in a number of consecutive rows spaced apart with a constant spacing e, and each containing eight needles.

If reference is now made to FIGS. 1 and 2, the device comprises a number of identical, parallel plates 2, which are spaced uniformly with a spacing e that is the same as that of the rows of needles in the Jacquard machine, and which are secured to a perforated guide plate 3. In the particular embodiment illustrated, as the device is designed to push vertical falling needles 1 of a Jacquard machine, the plates 2 are vertical, while the perforated guide plate 3 is horizontal. More generally, the perforated guide plate 3 will be oriented in a plane that is transverse to the needles 1 of the Jacquard machine, and the plates 2 will be oriented in a plane that is parallel to the plane of the needles.

Each perforation 3*a* of the guide plate 3 is intended to face a needle 1 of the Jacquard machine. If reference is made to FIG. 1, these perforations are therefore arranged in a number of consecutive rows 4, there being eight perforations 3*a* per row, each row 4 of perforations 3*a* corresponding to a row of needles 1 of the Jacquard machine. In addition, the vertical plates 2 are arranged with respect to the guide plate 3 in such a way that one row 4 of perforations 3*a* lies between two consecutive plates 2. A limited number of rows 4 has been illustrated in FIG. 1. In practice, the Jacquard machine may have more than one hundred rows of needles.

Inserted between each plate 2 are eight vertical pushers 5, there being one pusher 5 per needle 1 of a same row. The pushers 5 positioned between two plates 2 are each mounted so that they can slide in the same plane 5*a* parallel to the plates 2, between a position that is retracted with respect to the plates 2, hereafter known as the down position, and a position which is deployed with respect to the plates 2, hereafter known as the up position, and are guided in their translation by two supports 6*a* and 6*b* which allow each pusher 5 to be immobilized horizontally.

In FIG. 2, the device is positioned with respect to the needles of the Jacquard machine in a so-called pushing position which is such that each pusher 5 is vertically in line with a needle 1. In this pushing position, the device can be given a movement of translation with respect to the needles 1 in a so-called pushing direction depicted by the double-headed arrow D and which, in this instance, is vertical. When the device is in its pushing position, only those pushers 5 which are in the up position come into contact with the corresponding needles 1 via their upper end 5*d* known as the pushing end. Thus, in its pushing position, when the device moves vertically upwards, only those needles 1 that are associated with a pusher 5 in the up position are raised by the device when it moves. In the context of the invention, depending in particular on the specific type of Jacquard machine on which it is mounted, the device may either be constantly in its pushing position, and have a single movement of translation with respect to the needles, or, on each cycle of the Jacquard machine, in addition to the translational movement in the pushing direction, be given a movement which brings it into its pushing position.

Mounted in each space delimited by two consecutive plates 2 are eight selector members 7 which are positioned in the same plane 7*a* parallel to the plates 2, that is to say, in this instance, in one same vertical plane. Each selector member 7 is associated with a pusher 5 and can slide horizontally under the action of electromagnetic means which will be described later, between a selection position in which the corresponding pusher 5 is locked in the up position, and a retracted position in which the pusher 5 is no longer locked in the up position and drops into the down position under the effect of gravity.

In the embodiment of FIG. 2, the eight selector members 7 are distributed in two groups of four on each side of the pushers 5. The four selector members 7 of one same group are guided in their sliding by two supports 8*a* and 8*b* which allow each selector member 7 to be immobilized vertically. Thus, when a pusher 5 is locked in the up position by its selector member 7, and raises the corresponding needle 1 of the Jacquard machine, the weight of this needle is taken up by the supports 8*a* and 8*b*.

In the particular embodiment illustrated, each selector member consists of a thin flat tab 9 of approximately rectangular shape. As is clear in FIG. 3, the plane 7*a* of the selector tabs 9 between two plates 2 is offset with respect to the plane 5*a* of the pushers 5, so that the pushers 5 cannot obstruct the horizontal sliding of the selector tabs 9. The end 9*a* of each tab 9 terminates in a lateral lug 10 which is oriented so that it is transverse to the plane of the tab, so as to intersect the plane 5*a* of the pushers 5. Furthermore, a notch 5*b*, which in this case is in the shape of a U, is made in each pusher 5. The notch 5*b* of a given pusher 5 is designed in such a way that once the pusher 5 is in the up position, it is at the same level as and in line with the tab 9. Thus, once a pusher 5 has been brought into the up position, when the corresponding tab 9 is brought into the selection position by sliding it horizontally, its lateral lug 10 becomes inserted in the notch 5*a* of the corresponding pusher 5, and allows this pusher 5 to be vertically immobilized in the up position. By contrast, when the lug 10 is disengaged from the notch 5*b* of the corresponding pusher 5, by sliding the tab 9 horizontally in the opposite direction, which corresponds to the position of the lug 10 shown in dotted line in FIG. 3, the pusher 5 is no longer held vertically and drops into the down position.

In a preferred alternative form, for the electromagnetic control of the sliding of the eight selector tabs 9 inserted between two plates 2, each plate 2 is equipped with eight soft iron field frames 11 comprising a base 12 and three lateral legs forming an approximate E with the base 12, namely two end legs 13*a* and a central leg 13*b*. A winding 14 is wound around the central leg 13*b*. The two end legs 13*a* thus constitute two electromagnetic polar ends of the same sign, and the central leg 13*b* constitutes a wound core forming an electromagnetic polar end of the opposite sign to the end poles 13*a*. The signs of the end poles 13*a* and of the central pole 13*b* will be fixed by the direction in which the current flows through the winding 14.

Each field frame 11 is fixed through the plate 2 in an opening provided for this, so that the base 12 is positioned on the face 2*a* of the plate 2, and the poles 13*a* and 13*b* are positioned on the other face 2*b* of the plate 2. If reference is made to FIG. 3, it is clearly evident that the poles 13*a* and 13*b* of a wound field frame 11 of a given plate 2 (the lower plate in FIG. 3) lie opposite the base 12 of the field frame 11 of the plate adjacent to it (upper plate in FIG. 3), and thus, with this base 12, form an electromagnetic circuit allowing two opposed induced electromagnetic fields C1 and C2 to be created locally in the space between plates 2. These two electromagnetic fields are oriented so that they are transverse to the plane of the plates 2 and have been depicted diagrammatically by two dotted lines in FIG. 3. In other words, the base 12 of the wound field frames 11 of each plate 2 constitutes an armature which closes the two electromagnetic fields induced by the wound part opposite of the adjacent plate, which wound part is formed of two end poles 13*a* and of a central pole 13*b*.

Each selector tab 9 is equipped with two permanent magnets 15*a* and 15*b* mounted in opposition. Each pair of magnets 15*a* and 15*b* of a selector tab 9 is positioned between the base 12 and the three poles 13*a*, 13*b* of a given electromagnetic circuit. In FIG. 2, for reasons of clarity, only the windings 14 of each electromagnetic circuit have been depicted in dotted line, the field frames 11 of the plates 2 not having been depicted. As is clearly apparent from this figure, the electromagnetic circuits are split into two groups of four circuits, on each side of the pushers 5, and the circuits of one same group are laterally offset in the plane of the plate, which makes it possible to obtain a saving in terms of height. Obviously, this same offset is to be found with the pairs of magnets 15*a* and 15*b* of the tabs 9 of one same group.

The two magnets 15*a* and 15*b* of a tab 9 constitute a dipole, the dimensions of which are such that it can route its magnetic field onto one or other of the end poles 13*a*, depending on the direction of the two induced electromagnetic fields C1 and C2, that is to say depending on the direction in which current is made to flow through the winding 14. In FIG. 3, the dipole which consists of the two magnets 15*a* and 15*b* of the tab 9 tends to route its magnetic field onto the right-hand end pole 13*a* of the wound field frame 11 of the lower plate 2, the tab 9 thus experiencing a force which tends to move it to the right. A first indexing stop 16 is provided, at the end 9*a* of the tab 9 and allows the tab to be kept stably in this position, which corresponds to its selection position, the lug 10 being inserted in the notch 5*b* of the pusher 5. When the direction of the flow of current through the winding 14 is reversed, the direction of the two induced electromagnetic fields C1 and C2 reverses. The dipole formed by the two magnets 15*a* and 15*b* tries to route its magnetic field onto the left-hand end pole 13*a*, which causes the selector tab 9 to move to the left. At the ends 9*b* of each tab 9 there is a second indexing stop 17 (FIG. 2). The tab 9 is therefore brought into a stable position against this stop 17 (the position in dotted lines in FIG. 3), which position corresponds to the withdrawn position of the selector tab, the lug 10 being disengaged from the notch 5*b* in the pusher 5. The function of the two indexing stops 16 and 17 is to prevent the dipole formed by the two magnets 15*a* and 15*b* from moving forward as far as a position in which it would be centered on the corresponding end pole 13*a*.

The particular alternative embodiment illustrated in FIG. 3, and employing three electromagnetic polar ends 13*a*, 13*b*, a pair of magnets 15*a*, 15*b* mounted in opposition, and two indexing stops 16 and 17, advantageously makes it possible to obtain a selector member 7 which remains stable in its withdrawn position or in its selection position, even if the current in the winding 14 is cut off. Indeed, when the current in the winding 14 is cut off once the selector member 7 is in its withdrawn or selection position, the dipole formed by the two magnets 15*a* and 15*b*, on account of its magnetic field, attempts to center itself on the corresponding polar end 13*a*, that is to say, in FIG. 3, on the right-hand polar end 13*a* when the selector member 7 is in the selection position, and on the left-hand polar end 13*a* when the selector member is in the withdrawn position. The selector member therefore remains continuously pressed against the corresponding indexing stop 16 or 17, even when there is no current flowing through the winding 14. By virtue of this alternative form, on the one hand, it is unnecessary, once the selector member has been brought into its retracted or selection position, for current to be maintained in the winding 14 for all of the time during which the needles of the Jacquard machine are being pushed and, on the other hand, the control of the Jacquard machine is not affected in the event of an instantaneous break in current in a winding during a cycle.

Referring to FIG. 2, in order to supply electrical power to the windings 14 of the field frames 11, each plate 2 is fitted with a connector 18 with nine terminals 19, and acts as a support for a printed circuit 20 allowing one of the two ends of each winding 14 to be connected to one same terminal 19 which acts as a common ground, and the other end of each winding 14 to a given terminal 19. The terminals 19 of the connector 18 of each plate 2 are connected to a processing unit (not depicted) which is programmed to deliver, on each cycle of the Jacquard machine, the operating voltage required for each winding 14, depending on whether or not the corresponding tab 9 is to lock the corresponding pusher 5 in the up position, this amounting to a simulation of a solid part or of a hole, respectively, in a punched card.

For it to be possible for the pushers 5 to be locked in the up position, it is necessary for them to be brought mechanically into this position prior to locking them. This is achieved using a reset plate 21 which can move in terms of translation with respect to the plates 2 and to the selector tabs 9, and along the axis 5*e* of the pushers 5, between a down position and an up position which are depicted in dotted line in FIG. 2. In the example illustrated, all the pushers 5 consist of rods of the same length, whose lower end 5*c*, known as the setting end, projects with respect to the lower edge of the row of plates 2, at least when the pusher 5 is in the down position. The reset plate 21 is positioned in such a way that when it is in the down position, the reset ends 5*c* of the pushers 5 which are in the down position come into contact with the upper face of the plate 21.

The way in which the device just described with reference to FIGS. 1 to 3 operates is as follows. On each cycle of the Jacquard machine, the device is in a so-called reset position, in which none of the pushers 5, irrespective of its position, can come into contact with the needles 1. When the device is in this reset position, the reset plate 21 is brought into the up position, and pushes into the up position all those pushers which were not locked in the up position in the previous cycle. Next, while the reset plate is in the up position, the processing unit (not depicted) delivers the appropriate voltages for each winding 14, so as to bring or, as appropriate, keep the corresponding selector tab 9 into or in the withdrawn or selection position. Next, the reset plate 21 is lowered. The pushers 5, the selector tab 9 of which is in the withdrawn position, drop under gravity into the down position. The other pushers are locked in the up position with respect to the plates 2. Next, the entire device is, as appropriate, brought into the pushing position as was described earlier, and is then moved into the pushing direction D in order to individually raise those needles of the Jacquard machine which have been selected.

The reset plate 21 advantageously has low inertia and therefore allows movements of a high frequency with a relatively large amplitude. The outward and return movement of the reset plate 21 between its down position and its up position corresponding to the incremental rotation of the drive cylinder conventionally used for driving the punched cards. Advantageously, use will be made of means which already exist in the Jacquard machine for rotating the cylinder which has been replaced by the device of the invention, for raising and lowering the reset plate 21.

The main advantage of the invention lies in the fact that it makes it possible to produce a device in which the spacing e between two consecutive plates can be very small, and is furthermore independent of the number of needles per row in the Jacquard machine. In particular, it has been possible to produce a device according to FIGS. 1 to 3 that allows the control of the needles 1 of a Jacquard machine in which the consecutive rows were spaced at a spacing e of 6 mm.

Another advantage of the invention lies in its modular design. It is actually very easy to modify a given design to adapt it to another Jacquard machine with the same spacing e between rows, but which may have a different number of rows of needles, or alternatively a different number of needles per row. All that is required for this is for the desired number of plates 2, of selector members 7 and of pushers 5 to be removed or added. It should, at this point, be pointed out that as the selector members 7 and the pushers 5 are simply mounted so that they can slide with respect to the plates 2, they are very easy to assemble or, on the other hand, disassemble in the inter-plate spaces, and these operations require no special tools.

The invention is not restricted to the preferred embodiment described with reference to FIGS. 1 to 3. By way of non-exhaustive examples, the device of the invention may be produced in the following versions:

It is conceivable for use to be made of two-pole wound field frames for the electromagnetic control of the selector members. In this case, each electromagnetic circuit creates just one induced electromagnetic field and each selection member will comprise just one permanent magnet. In this alternative version, when a winding is powered with a given voltage, it causes the selector member to move in order to bring it to the end of its travel in a given position. This may either be the withdrawn position or the selection position. Each selector member further comprises an elastic return means, for example a coil spring, which is compressed when the selector member is kept in the end-of-travel position by the electromagnetic means. When the current in the winding 14 is cut off, the elastic return means returns the selector member in the opposite direction into its withdrawn or selection position, as the case may be.

In another alternative form, the axis 5*e* of the pushers 5 may be horizontal. In this alternative form, the pushers can no longer drop back into the retracted position under gravity. In this version, each pusher will therefore be fitted with an elastic return means of the coil spring type which is compressed when the pusher is in its deployed position and whose function is to return the pusher to the retracted position by relaxing, when the pusher is no longer selected and when the reset plate leaves its position in which it keeps the pushers in the deployed position.

The use of pushers advantageously allows the production of selector members which have a very short travel, and more particularly a travel which is smaller than the width 1 of a needle (FIG. 2). It is therefore possible to control the needles of a Jacquard machine in which the distance d between two adjacent needles of one same row (FIG. 2) is less than the width 1 of a needle. It has thus been possible to produce a pushers device according to FIGS. 1 to 3 with an inter-pusher distance, which corresponds to the distance d, of about 2 mm. However, in the context of the invention, if the distance d is not a restricting factor, and in particular is equal to or exceeds the width 1, it is conceivable for the needles to be operated directly by the selector members. In this case, each selector member will be designed to close the corresponding orifice 3*a* in the guide plate 3. The selector members will, for example, consist of flat L-shaped tabs.

In the context of the alternative form of FIGS. 1 to 3, the reset plate 21 pushes each pusher 5 via its setting end 5*c* which is the opposite end to its pushing end 5*d*, and which projects with respect to the plates 2. The reset plate may therefore advantageously consist of a simple, thin, solid plate. In another alternative form, the reset plate may be a perforated plate through which the pushing ends 5*d* of the pushers 5 pass and whose function is to pull the pushers into the deployed position. For this purpose, each pusher will be equipped, for example, with a collar at its pushing end. The function of this collar will be to interact with the reset plate in order to bring the pusher into the deployed position. In this alternative form, it is unnecessary for the setting end 5*c* of the pushers 5 to project with respect to the plates, and each selector member 7 may be designed in such a way as to immobilize the corresponding pusher 5 in the deployed position at its reset end, in a similar way to the alternative form of FIG. 4 of European Patent Application EP.A.0.382.998.

Finally, in another embodiment of the invention, the pushers 5 are placed in the deployed position with respect to the plates 2, not by translation of the reset plate 21 in the direction of the pushers, but rather by a translation with respect to the reset plate 21 of the assembly formed by the plates 2 and the selector member 7, along the axis 5*e* of the pushers 5. The way in which this embodiment works is as follows. Prior to moving the selector members 7, the plates 2—selector members 7 assembly is brought toward the reset plate 21, into a first position in which all the pushers 5 are in contact with the reset plate. During this movement, the pushers 5 which are locked in the deployed position with respect to the plates 2 are driven toward the reset plate 21, while the other pushers 5 which are not locked in the deployed position remain unmoved in contact with the reset plate 21. In this first position of the plates 2—selector members 7 assembly, all the pushers 5 are placed in the deployed position with respect to the plates 2. Once the plates 2—selector members 7 assembly has been brought into this first position, the appropriate selector members 7 are made to move so as to lock selectively in the deployed position those pushers 5 which are to act on the needles of the Jacquard machine 5 during the next cycle. Once the appropriate pushers 5 have been locked in the deployed position, the plates 2—selector members 7 assembly is moved in the opposite direction with respect to the reset plate. The pushers 5 which are locked in the deployed position are driven by this assembly as far as the second position in which the pushers 5 which are locked in the deployed position come into contact with the corresponding needles of the Jacquard machine. Those pushers 5 which are not locked with respect to the plates 2 remain unmoved, in contact with the reset plate 21, the (plates 2—selector members 7—pushers 5 locked in the deployed position) assembly sliding with respect to the unlocked pushers 5.

What is claimed is:

1. A Jacquard machine having a device for automated actuation of needles of the Jacquard machine, the needles being arranged in parallel consecutive rows having a spacing between the rows, the device, being adapted to be moved in each cycle of the Jacquard machine with respect to the needles to push the needles individually and selectively and employing, for each needle, at least one of a plurality of selector members which are adapted to move in a direction that is transverse to a direction of pushing of the device between a first, selection, position and a second, withdrawn, position, and wherein movement between the two, selection and withdrawn, positions can be controlled electromagnetically in such a way that as the device moves, the device pushes only those needles of the Jacquard machine which are associated with a selector member that is in the selection position, wherein the device comprises a number of parallel plates spaced apart in pairs at a spacing which is adapted to be the same as the spacing separating two consecutive rows of needles, and wherein the selector members associated with the needles of the same row are mounted in the space between two consecutive plates, the selector members being adapted to move in a plane parallel to a plane of the plates, wherein for each selector member, there is a two-part electromagnetic circuit allowing the creation of at least one induced electromagnetic field which is oriented so that it is transverse to the plane of the plates, the two parts of the electromagnetic circuit being mounted, one on each opposing face of two plates and comprising, respectively, a wound main part with at least two opposite electromagnetic polar ends, and an armature for closing the electromagnetic field, the armature being positioned opposite the wound main part, each selector member comprising a magnetized part which is positioned between the two parts of the associated electromagnetic circuit, so as to allow movement of the selector member to be controlled.

2. The Jacquard machine according to claim 1, wherein each plate of the device comprises, on one of its faces, the wound part of the electromagnetic circuit and, on its other face, the armature which is intended to close the induced electromagnetic field of the wound part of the adjacent plate.

3. The Jacquard machine according to claim 2, wherein each armature of a plate of the device consists of a base of a ferromagnetic field frame, of which the part opposite the base is wound, and which is fixed through the plate in such a way that the base and the wound part of the field frame lie one on each side of the plate.

4. The Jacquard machine according to one of claims 1 to 3, wherein each wound part of the device comprises three electromagnetic polar ends, respectively forming two end electromagnetic poles of the same sign, and a central electromagnetic pole of the opposite sign, which constitutes the wound core, wherein the magnetized part of each selector member consists of two permanent magnets mounted in opposition in such a way that by controlling the direction which current flows through the winding of the central pole, the movement of the selector member in one direction or in the other along an axis of movement is controlled, so as to bring it to the end of its travel in the selection position or in the withdrawn position.

5. The Jacquard machine according to claim 2, wherein each plate of the device is fitted with a connector for supplying power to the windings, and acts as a support for a printed circuit connecting each winding to the connector.

6. Jacquard machine according to claim 1, wherein the device further comprises, between each plate and for each selector member, a separate pusher which can move with respect to the plates in the plane of the plates and along an axis in a direction that is transverse to the axis of movement of the selector members, and which can be locked in a deployed position with respect to the plates by the associated selector member, in which position the pusher can push the associated needle of the Jacquard machine when the device moves.

7. The Jacquard machine according to claim 6, wherein the device further comprises a reset plate, and wherein an assembly formed by the plates and the selector members can move in terms of translation with respect to the reset plate along the axis of the pushers, between a first position, in which all of the pushers are in contact with the reset plate, and in the deployed position, and a second position, in which only those pushers which are locked in the deployed position with respect to the plates are brought into contact with the corresponding needles of the Jacquard machine, the pushers which are not locked in the deployed position not being driven and remaining in contact with the reset plate.

8. The Jacquard machine according to claim 6, wherein the device further comprises a reset plate which can move in terms of translation with respect to the plates and to the selector members and along the axis of the pushers, and the function of which, in each cycle of the Jacquard machine, is to bring the pushers into the deployed position and hold them there with respect to the plates while the selector members are made to move.

9. The Jacquard machine according the claim 8, wherein the axis of the pushers of the device is vertical, and the reset plate can move between a down position and an up position in which it supports all the pushers in the deployed position, so that the pushers which are not locked in the deployed position by their selector member drop back into a retracted position under gravity when the reset plate moves from its up position to its down position.

10. The Jacquard machine according to claim 8, wherein the axis of the pushers of the device is horizontal and in that each pusher comprises an elastic position-return means which is compressed when each pusher is kept in the deployed position by the reset plate, and which allows the pusher to be returned to the retracted position when the reset plate leaves its position.

11. The Jacquard machine according to claim 7, wherein the pushers of the device further comprise rods of identical length, with a first, pushing, end intended to come into contact with a needle, and a second, setting, end which projects from the row of plates and is intended to come into contact with the reset plate.

12. The Jacquard machine according to claim 11, wherein the selector members of the device consist of flat tabs, wherein in the space between two consecutive plates, all the pushers are positioned in a same plane parallel to the plates, and all the tabs are positioned in a same plane parallel to the plates but offset with respect to the plane of the pushers, so that the pushers do not obstruct the movement of the tabs, in that each pusher comprises a notch for immobilizing it in the deployed position, and in that each tab comprises a lateral lug which is transverse to the plane of the tab and which, when the tab is brought into the selection position, becomes inserted in the notch in the corresponding pusher in order to lock it in the deployed position.

13. In combination:

a Jacquard machine having needles arranged in parallel consecutive rows, each row having a spacing therebetween; and a device for automated actuation of the needles of the Jacquard machine, the device being adapted to be moved with each cycle of the Jacquard machine with respect to the needles to push the needles individually and selectively, the device comprising:

a number of parallel plates spaced apart in pairs at a spacing adapted to be the same as the spacing separating two consecutive rows of needles in the Jacquard machine;

a plurality of selector members mounted in the spacing between two plates of a pair and associated with a corresponding row of needles, the selector members being adapted to move in a same plane parallel to a plane of the plates and in a direction that is transverse to a direction of pushing of the device; and a two-part electromagnetic circuit for each selector member allowing the creation of at least one induced electromagnetic field, the electromagnetic circuit being oriented transverse to the plane of the plates, two parts of the electromagnetic circuit being mounted on opposing faces of two plates and including a wound main part with at least two opposite electromagnetic polar ends, and an armature for closing the electromagnetic field, the armature being positioned opposite the wound main part, wherein each selector member comprises a magnetized part positioned between the two parts of the associated electromagnetic circuit to allow the movement of the magnetized part to be controlled.

* * * * *